United States Patent [19]

Sakai et al.

[11] Patent Number: 4,969,798

[45] Date of Patent: Nov. 13, 1990

[54] DIFFUSER FOR A CENTRIFUGAL COMPRESSOR

[75] Inventors: Haruki Sakai; Yoshiaki Abe, both of Ibaraki; Koji Nakagawa, Tsuchiura, all of Japan

[73] Assignee: Hitachi, Ltd., Tokyo, Japan

[21] Appl. No.: 304,576

[22] Filed: Feb. 1, 1989

[30] Foreign Application Priority Data

Feb. 26, 1988 [JP] Japan ..... 63-43825

[51] Int. Cl.[5] ..... F04D 29/44

[52] U.S. Cl. ..... 415/157; 415/48; 415/150

[58] Field of Search ..... 415/148, 149.1, 150, 415/157, 158, 162, 164, 47, 48, 151; 74/569, 55

[56] References Cited

U.S. PATENT DOCUMENTS

| | | | |
|---|---|---|---|
| 2,566,550 | 9/1951 | Birmann | 415/148 |
| 2,861,774 | 11/1958 | Buchi | 415/157 |
| 3,362,624 | 1/1968 | Endress | 415/149.1 |
| 3,362,625 | 1/1968 | Endress | 415/149.1 |
| 3,989,016 | 11/1976 | Morgan | 74/569 |
| 4,219,305 | 8/1980 | Mount et al. | 415/158 |
| 4,257,733 | 3/1981 | Bandukwalla et al. | 415/158 |
| 4,484,857 | 11/1984 | Patin | 415/150 |
| 4,802,817 | 2/1989 | Tyler | 415/157 |
| 4,844,690 | 7/1989 | DeLaurier et al. | 415/148 |
| 4,877,370 | 10/1989 | Nakagawa et al. | 415/148 |

FOREIGN PATENT DOCUMENTS

| | | | |
|---|---|---|---|
| 1913048 | 2/1970 | Fed. Rep. of Germany . | |
| 133613 | 10/1979 | Japan | 415/157 |
| 159998 | 10/1982 | Japan . | |
| 407401 | 8/1966 | Switzerland . | |

*Primary Examiner*—John T. Kwon

*Attorney, Agent, or Firm*—Antonelli, Terry, Stout & Kraus

[57] ABSTRACT

In a diffuser for a centrifugal compressor of the type which includes an impeller rotatably provide on a downstream side of the suction casing and a plurality of radial stator blades arranged tangentially with respect to the impeller, auxiliary blades are provided between the impeller and the stator blades, with the auxiliary blades having a chord length shorter than that of the stator blades and being slidable in the axial direction of the impeller. Further, the auxiliary blades are connected to devices designed to move them in the axial direction.

6 Claims, 5 Drawing Sheets

DIFFUSER FOR A CENTRIFUGAL COMPRESSOR

BACKGROUND OF THE INVENTION

1. Field of the Invention

This invention relates to a diffuser for a centrifugal compressor, and in particular, to a diffuser for a centrifugal compressor which can be operated highly efficiently over a wide range of flow rate, i.e. from a low rate to a rated one.

2. Description of the Prior Art

Generally, a centrifugal compressor includes a suction casing having a scroll, with an impeller being rotatably arranged in the suction casing for generating a high-speed air flow. Since the air flow going out of the impeller has large kinetic energy, a diffuser is provided on the downstream side of the impeller, i.e., outside the impeller, so that the kinetic energy of the flow discharged from the impeller may be converted into pressure energy. The diffuser is composed of stator blades radially arranged around the outer periphery of the impeller, and diffuser passages are formed between the stator blades.

In such a compressor, a phenomenon called surging, occurs in a low flow rate, where separation flows are generated on the suction or negative-pressure-side surfaces of the stator blades, and a sufficient pressure rise cannot consequently be attained.

In view of this, Japanese Patent Application Laid-Open No. 57-159998 discloses a diffuser which suppresses the surging even under a low-flow-rate condition. According to the disclosure, rotatable auxiliary or sub blades are provided in the inlet section of the diffuser, with the air flow through the diffuser being controlled by rotating these auxiliary blades, thereby preventing occurrence of separation flow on the suction or negative pressure-side surfaces of the stator blades.

However, while provision of the above-mentioned auxiliary blades helps to prevent the occurrence of surging under a low-flow-rate condition, another type of problem is encountered under a rated-flow-rate condition. Under the rated-flow-rate condition, the fluid lashes against these auxiliary blades, resulting in augmented pressure loss such as impact or collision loss and friction loss which leads to the operation efficiency of the compressor deteriorating.

SUMMARY OF THE INVENTION

It is accordingly an object of this invention to provide a diffuser for a centrifugal compressor which is capable of preventing the occurrence of surging and of reducing the pressure loss over a wide flow rate range, from a low flow rate to a rated flow rate.

Another object of this invention is to provide a diffuser for a centrifugal compressor which enables the compressor to be operated with high efficiency over a wide flow rate range, from a low flow rate to a rated flow rate.

In accordance with this invention, a diffuser is provided, to accomplish the objects above, for a centrifugal compressor of the type that includes an impeller rotatably provided on a downstream side of a suction casing and a plurality of radial stator blades arranged tangentially with respect to the impeller, with kinetic energy of fluid discharged by rotation of the impeller being converted into pressure energy. The diffuser includes auxiliary or sub blades provided between the impeller and the stator blades, with each of the auxiliary blades having a chord length shorter than that of the stator blades and being slidable in an axial direction of the impeller. Means are provided for displacing the auxiliary blades in the axial direction, with the displacing means being connected to the auxiliary blades In order to achieve still higher operational efficiency, the diffuser in accordance with this invention further includes a whirl generating means, with the whirl generating means being provided in the suction casing on an upstream side thereof and operatively connected with the auxiliary blades to generate the whirl in the fluid in the suction casing.

In the diffuser constructed above, pressure loss can be lowered by retracting the auxiliary blades from the diffuser passages when the flow rate is a rated flow rate. Otherwise, relatively large pressure loss would be unavoidable at the rated flow rate region due to the fluid in the diffuser lashing against the auxiliary blades or due to friction between the fluid and the auxiliary blades. When, on the other hand, the flow rate is relatively low, the auxiliary blades are displaced or moved into the diffuser passages. This causes the flow in the vicinity of inlets of the stator blades to be guided along the stator blades, thereby suppressing generation of the separation flow and preventing the occurrence of surging.

Further, the whirl generating means provided in the suction casing on the upstream side therein helps to generate a whirl flow in the suction casing. Through cooperation between the whirl generating means and the auxiliary blades, a highly efficient operation can be performed over a wide operation range, from a lower flow rate to the rated flow rate.

Other characteristics and advantages of this invention will become apparent from the following description of the preferred embodiments.

DETAILED DESCRIPTION OF THE PREFERRED EMBODIMENTS

Embodiments of this invention will no be described with reference to the attached drawings.

Figure 1:
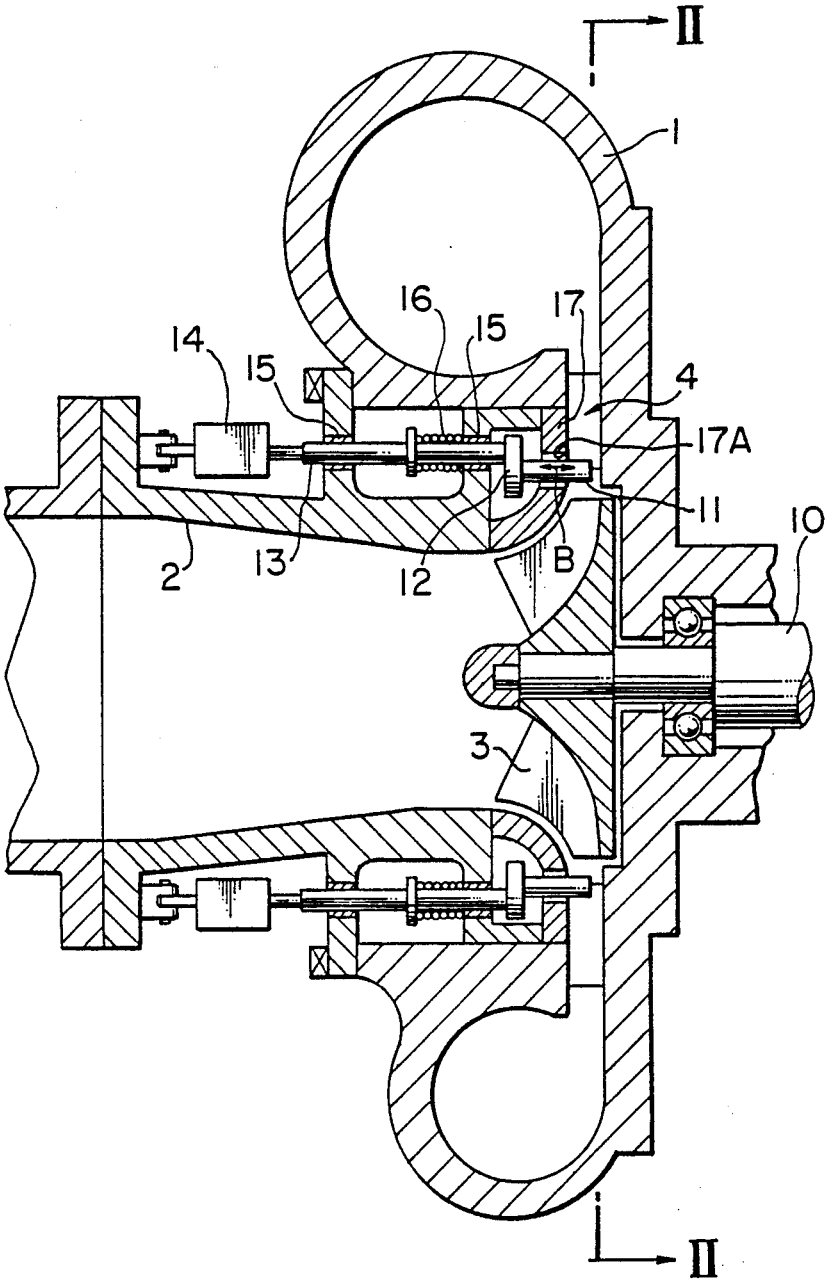
FIG. 1 is a longitudinal front sectional view of a centrifugal compressor to which this invention is applied.
Figure 2:
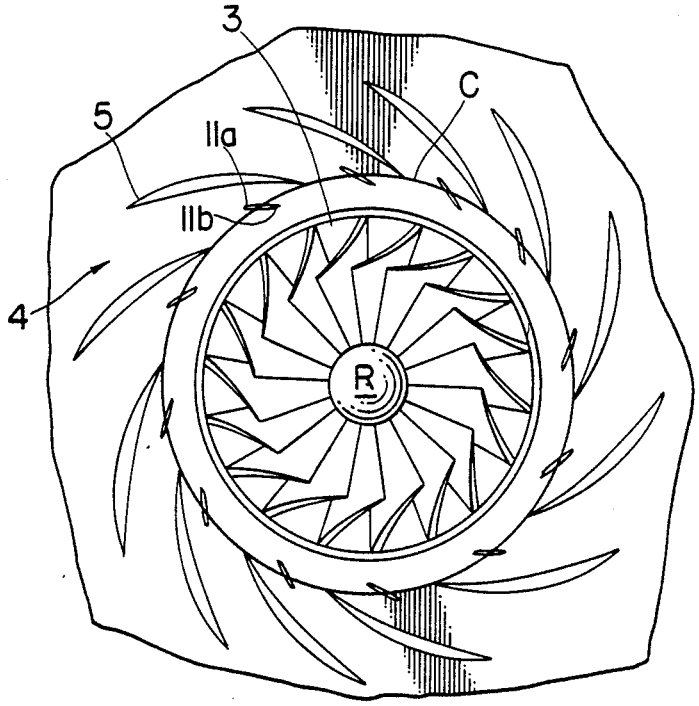
FIG. 2 is a sectional view taken along the line II—II of FIG. 1.

As shown in FIG. 1, the centrifugal compressor includes a scroll 1 having a suction casing 2 provided in a central section thereof, with an impeller 3 being rotatably mounted on a downstream side section of the suction casing 2. The impeller 3 is connected through a rotary shaft 10 to driving means (not shown) and is rotated by the torque from the driving means. A diffuser 4 is provided outside the impeller 3, with auxiliary or sub-blades 11 being arranged between the diffuser 4 and the impeller 3. The auxiliary or sub blades 11 are connected through auxiliary blade mounting plates 12 and driving shafts 13 to respective actuators 14 for enabling the auxiliary blades 11 to be moved in the direction indicated by the arrow B upon operation of the actuators 14. FIG. 2 illustrates the positional relationship of the impeller 3, the diffuser 4 and the auxiliary blades 11 and, as shown in FIG. 2, the diffuser 4 is composed of multiple radial stator blades 5 arranged tangentially around the outer periphery of the impeller 3. The auxiliary blades 11 are arranged between the stator blades 5 and the impeller 3 in such a manner that each of the auxiliary blades 11 is approximately parallel to the stator blade 5 nearest thereto. The chord length of the auxiliary blades 11 is shorter than that of the stator blades 5 and one side surface 11*a* of the respective auxiliary blades 1 confront an adjacent stator blade 5, with the other side surface 11*b* not confronting a neighboring stator blade 5. The auxiliary blades 11 are situated at positions intersecting a circle C having a center thereof disposed at a center of rotation R of the rotary shaft 10 of the impeller 3 and which passes through an inner end of the stator blades.

As shown in FIG. 1, ends of each of the driving shafts 13 connected to the respective auxiliary blades 11 are supported by a pair of bearings 15 provided on the casing 2, with a spring 16 being provided in the middle section of each driving shaft 13 and serving to urge the driving shafts 13 toward the actuators 14. An indicates an auxiliary casing 17 is provided between the scroll 1 and the suction casing 2, with the auxiliary casing 17 includes penetrating holes 17A through which the auxiliary blades 11 are inserted.

When the impeller 3 is operated at a flow rate around the rated flow rate, the actuators 14 are operated to allow the auxiliary blades 11 to be moved or displaced leftward as viewed in FIG. 1, by the resilient expansion of the compression springs 16. Thus, the auxiliary blades 11 are retracted from the passages in the diffuser 4, and the resistance to fluid flow in the diffuser passages due to the auxiliary blades 11 can be lowered, thereby improving the efficiency of the centrifugal compressor. The auxiliary blades 11 can be completely retracted in from the diffuser passages or they may partly remain therein so that the efficiency of the centrifugal compressor may be adjusted to an optimum or maximum level.

When the impeller 3 is operated at a relatively lower flow rate region, separation of the fluid flow from the tip of the stator blades 5 may occur leading to the a phenomenon called surging. In such cases, the actuators 14 are operated to move or displace the auxiliary blades 11 righward in FIG. 1, against the resilience of the respective springs 16. Thus, the auxiliary blades 11 are displaced so as to protrude outwardly into the diffuser passages, and the occurrence of the separation flow on the stator blades 5 can be restrained thereby preventing the occurrence of surging. The degree to which the auxiliary blades 11 are displaced is adjusted in dependence upon the characteristics of the impeller 3.

Figure 3:
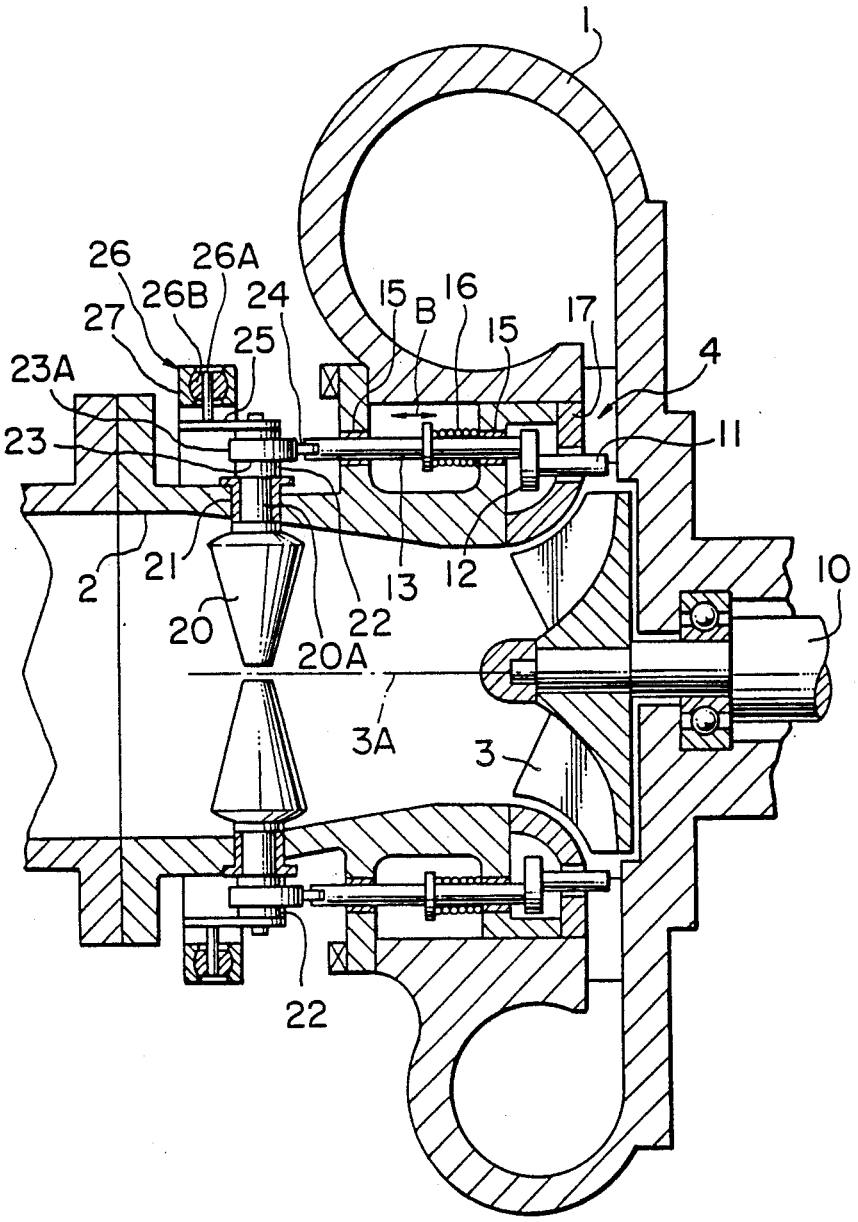
FIG. 3 is a longitudinal front sectional view of another embodiment of this invention.

In the embodiment of FIG. 3, an inlet vane controller for controlling the impeller capacity is incorporated into the aforementioned centrifugal compressor. In FIG. 3, the components or elements which are identical with those of FIG. 1 are referred to by the same reference numerals. The centrifugal compressor of the embodiment of FIG. 3 includes a plurality of inlet vanes 20, serving as capacity control by means of generating whirl to the impeller in the suction casing 2, which are arranged in the suction casing 2. The inlet vanes 20 are rotatably supported around respective axles 20A by respective bearings 21 mounted to the suction casing 2. Each of the axles 20A of the inlet vanes 20 includes a control axle 22, to which a cam 23 is fixed. The cam surface 23A of this cam 23 is in contact with a roller 24 24 rotatably mounted at one end of the driving shaft 13. Further, a control arm 25 is mounted on an end section of each of the control axles 22. Each control arm 25 is connected to an annular member 27 through a universal coupling o joint which is composed of a pin 26A and a spherical body 26B. The annular member 27 is rotationally displaced by a predetermined amount around the axis 3A of the impeller 3 by a driving means such as a link mechanism and a gear mechanism.

By thus rotating the annular member 27 by a predetermined amount, the inlet vanes 20 and the auxiliary blades 11 are simultaneously controlled.

Figure 4:
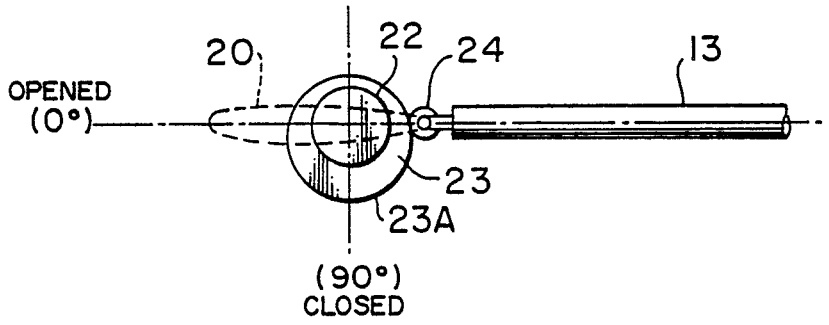
FIGS. 4 and 5 are plan views illustrating the operation of the inlet guide vane in the embodiment shown in FIG. 3.
Figure 5:
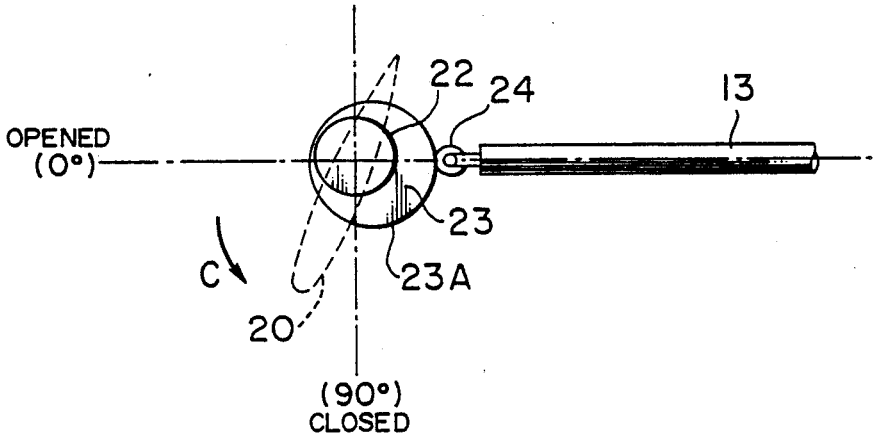

When the inlet vane 20 is in the completely open state as shown in FIG. 4, the driving shaft 13 is displaced to the left as viewed in the drawing. As a result of this displacement of movement, the auxiliary blade 11 is retracted from the diffuser passage. When the control axle 22 is rotated counterclockwise, the inlet vane 20 rotates in the direction indicated by the arrow C in FIG. 5. At the same time, the cam 23 and the cam roller 24 cause the driving shaft 13 to be moved to the right, thereby causing the auxiliary blade 11 to be protruded into the diffuser passage. By varying the configuration of the cam surface 23A of the cam 23, the amount of movement or displacement of the auxiliary blade 11 with respect to the amount of rotation of the inlet vane 20 can be adjusted as desired.

In this embodiment, the auxiliary blades 11 can be displaced so as to protrude into the diffuser passages or retracted therefrom in accordance with the flow rate, so that the centrifugal compressor can be operated with high efficiency over a wide operational range, from a low flow rate to a rated flow rate. Further, because the inlet vanes 20 serve as the whirl generating means operatively connected with the auxiliary blades 11 in the suction casing 2 on the upstream side, the operational range for the lower flow rates can be expanded, while at the same time a still higher operational efficiency can be attained, from a low flow rate to a rated flow rate.

Figure 6:
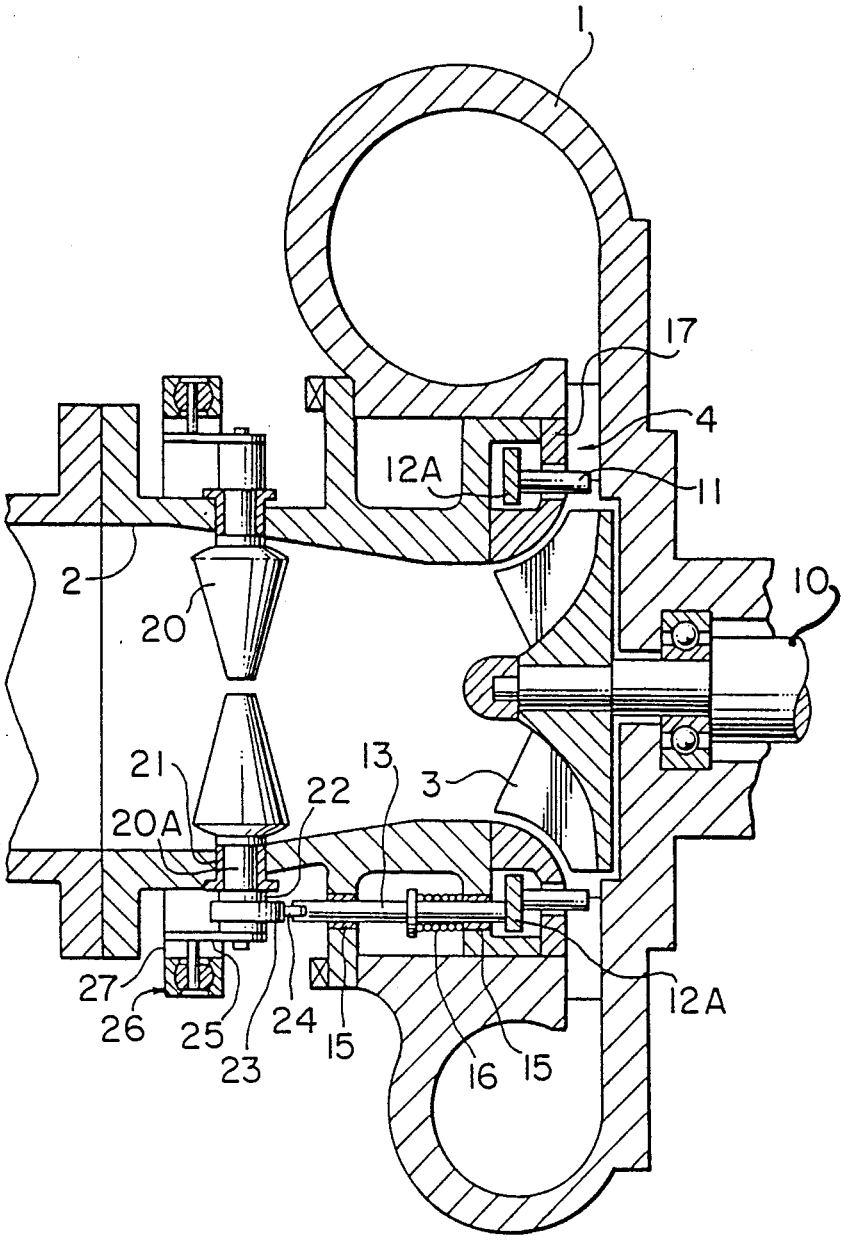
FIG. 6 is a longitudinal front sectional view, of still another embodiment of this invention.

In FIG. 6, components which are identical with those of FIG. 3 are referred to by the same reference numerals. In the embodiment of FIG. 6, the auxiliary blade mounting plates 12 of FIG. 3 are replaced by a single annular plate member 12A, which is movably provided in the space between the suction casing 2 and the auxiliary casing 17. A single driving shaft 13 is connected to the annular plate member 12A.

In FIG. 6, which provides the same advantages as the embodiment of FIG. 3, the operation mechanism for the auxiliary blades 11 is simplified.

As described above, in the diffuser of this invention, the auxiliary blades 11 can be displaced so as to protrude into the diffuser passages or retracted therefrom in accordance with the flow rate, so that a centrifugal compressor or a blower can be operated with higher operational efficiency over a wide operational range, from a low flow rate to a rated flow rate.

What is claimed is:

1. A diffuser for a centrifugal compressor including an impeller rotatably provided on a downstream side of a suction casing and a plurality of radial stator blades arranged tangentially with respect to said impeller, wherein kinetic energy of fluid discharged by rotation of said impeller is converted into pressure energy, said diffuser comprising:

auxiliary blades provided between said impeller and said stator blades, each of said auxiliary blades having a chord length shorter than a chord length of said stator blades and being slidable in an axial direction of said impeller, each of said auxiliary blades including a first surface arranged so as to confront a surface of an adjacent stator blade and a second surface opposite said first surface not confront a neighboring stator blade, said auxiliary blades being disposed at positions intersecting a circle having a center thereof at a center of rotation of said impeller and which passes through a radially inner end of said stator blades; and means connected to the auxiliary blades for displacing said auxiliary blades in the axial direction.

2. A diffuser for a centrifugal compressor as claimed in claim 1, wherein said means for displacing comprises driving shaft means supported by the suction casing so as to be movable parallel to the axis of the impeller, spring means for forcing said driving shaft means back to a suction side of said impeller, and an actuator means connected to said driving shaft.

3. A diffuser for a centrifugal compressor including an impeller rotatably provided on a downstream side of a suction casing and a plurality of radial stator blades arranged tangentially with respect to said impeller, wherein kinetic energy of fluid discharged by rotation of said impeller is converted into pressure energy, said diffuser comprising:

auxiliary blades provided between said impeller and said stator blades, each of said auxiliary blades having a chord length shorter than a chord length of said stator blades and being slidable in an axial direction of said impeller, each of said auxiliary blades including a first surface arranged so as to confront a surface of an adjacent stator blade and a second surface opposite said first surface not confronting a neighboring stator blade, said auxiliary blades being disposed at a position intersecting a circle having a center thereof at a center of rotation of said impeller and which passes through a radially inner end of said stator blades;

whirl generating means provided in said suction casing on an upstream side thereof for generating whirl in the fluid in the suction casing; and means for operatively connecting said auxiliary blades to said whirl generating means and for driving said auxiliary blades and said whirl generating means.

4. A diffuser for a centrifugal compressor as claimed in claim 3, wherein said whirl generating means comprises inlet vanes circumferentially arranged in the suction casing at intervals, and wherein said inlet vanes include axle means rotatably supported by the suction casing.

5. A diffuser for a centrifugal compressor as claimed in claim 4, wherein said means for operatively connecting said auxiliary blades to said whirl generating means comprises:

driving shafts respectively connected to said auxiliary blades and supported by the suction casing in such a manner so as to be movable parallel to the axis of the impeller;

springs for forcing said driving shafts back to a suction side of said impeller;

control axles provided on the axles of said inlet vanes;

cams provided on said control axles and adapted to operatively displace the other ends of said driving shafts;

control levers provided on said control axles in such a manner as to rotate them; and means for collectively rotating said control levers.

6. A diffuser for a centrifugal compressor as claimed in claim 4, wherein said means for operatively connecting said auxiliary blades to said whirl generating means comprises:

an annular plate member on which said plurality of auxiliary blades are mounted and which is movably provided in the casing;

a driving shaft connected to said annular plate member and supported by the suction casing in such a manner as to be movable parallel to the axis of the impeller;

a spring for forcing said driving shaft back to a suction side of said impeller;

control axles provided on the axles of said inlet vanes;

a cam provided on one of said control axle and adapted to operatively guide the other end of said driving shaft;

control levers provided on said control axles in such a manner as to rotate them; and means for collectively rotating said control levers.

* * * * *